US011780644B2

(12) United States Patent
Hubert

(10) Patent No.: US 11,780,644 B2
(45) Date of Patent: Oct. 10, 2023

(54) MULTICONFIGURABLE, COLLAPSIBLE, MODULAR TOTE CONTAINER

(71) Applicant: Garth Hubert, Provo, UT (US)

(72) Inventor: Garth Hubert, Provo, UT (US)

( * ) Notice: Subject to any disclaimer, the term of this patent is extended or adjusted under 35 U.S.C. 154(b) by 89 days.

(21) Appl. No.: 17/527,106

(22) Filed: Nov. 15, 2021

(65) Prior Publication Data

US 2023/0150720 A1 May 18, 2023

(51) Int. Cl.
*B65D 6/16* (2006.01)

(52) U.S. Cl.
CPC ..... *B65D 9/12* (2013.01); *B65D 11/18* (2013.01); *B65D 2519/00029* (2013.01); *B65D 2519/00064* (2013.01); *B65D 2519/00099* (2013.01); *B65D 2519/00169* (2013.01); *B65D 2519/00203* (2013.01); *B65D 2519/00238* (2013.01); *B65D 2519/00273* (2013.01); *B65D 2519/00293* (2013.01); *B65D 2519/00323* (2013.01); *B65D 2519/00333* (2013.01); *B65D 2519/00343* (2013.01); *B65D 2519/00373* (2013.01); *B65D 2519/00502* (2013.01); *B65D 2519/00606* (2013.01); *B65D 2519/00611* (2013.01); *B65D 2519/00661* (2013.01); *B65D 2519/00676* (2013.01); *B65D 2519/00711* (2013.01); *B65D 2519/00791* (2013.01)

(58) Field of Classification Search
CPC ... B65D 9/06; B65D 9/12; B65D 9/18; B65D 11/18; B65D 7/24; B65D 7/12; B65D 25/04; B65D 25/06; B65D 25/107
USPC ..... 220/666, 4.32, 4.28, 550, 549, 532, 529; 217/12 R, 13, 43 R, 45
See application file for complete search history.

(56) References Cited

U.S. PATENT DOCUMENTS 1,932,772 A * 10/1933 Eschenbach ..... B65D 21/08 217/65
6,415,938 B1 * 7/2002 Karpisek ..... B65D 19/12 220/6
6,752,285 B1 * 6/2004 Scalf ..... B65D 11/1873 220/4.32
2005/0161457 A1 * 7/2005 Enenkel ..... B65D 21/045 220/532

FOREIGN PATENT DOCUMENTS

CA 2697286 A1 * 9/2011 ..... A47F 5/114
DE 4137095 A1 * 5/1993 ..... B65D 11/1873

* cited by examiner

*Primary Examiner* — Robert J Hicks
(74) *Attorney, Agent, or Firm* — Steven Rinehart

(57) ABSTRACT

A modular, multiconfigurable container adapted to collapse for stowability and portability which is capable of being arranged in several geometries; whereby the container is operable to enable a user to assembly the container without tools, screws or external fasteners, and customize the container with minimal effort and skillset requirements for assemblage, so as to enable a user to customize said container for optimal stowing of categorized items in multiple interior bins, the container further configured to facilitate disassembly and stowage, one-man portability, and minimal tool and skillset requirements for assemblage. In various embodiments, the side panels and base panel are affixed together using a live hinge. The tote container further operates to allow a user to apply labels forwardly and rearwardly on the container within a recess adapted for that purpose.

15 Claims, 24 Drawing Sheets

1400

1500

1600

MULTICONFIGURABLE, COLLAPSIBLE, MODULAR TOTE CONTAINER

FIELD OF THE INVENTION

This invention relates to boxes, shelves and containers, and more particularly relates to a modular, multiconfigurable container adapted to collapse for stowability and portability which is capable of being arranged in several geometries; whereby the container is operable to enable a user to customize said container with minimal effort and skillset requirements for assemblage.

BACKGROUND

Description of the Related Art

Often workstation areas in residential or commercial settings do not provide users which efficiently shelves and storage containers for organizing and categorizing materials used at the workstation. It is important to users that shelves, boxes and containers used in workstation activities are generally adaptable to increase and decrease storage space. Users desire containers adapted to allow quick partition into multiple bins, but significant limitations exist in the art. Containers known in the art are not fully collapsible, stowable, divisible and stackable as needed by users trying to manage and categorize changing quantities of materials at a workstation while also being cost effective to construction and purchase.

This commercial space is extremely competitive and improvements to existing containers would create value which fulfill user's storage needs and allow preservation of inordinate space on desk surfaces and within containers. It is desirable to provide a container which is not limited by the deficiencies in the art. Conventional containers do not adequately meet these needs.

A container constructed from a relatively small number of components which can be arranged in several geometries, which is rigid and strong, and which is easily collapsible and stowable, would be desirable for workstation users.

SUMMARY

From the foregoing discussion, it should be apparent that a need exists for a m multiconfigurable, module tote assemblage constructed from a relatively small number of components and arrangeable in several basic geometries. Beneficially, such a container would include components adapted to enable quick partition and reconfiguration of the container to increase both the number and size of integrated partitions or binds within said container, without sacrificing the strength of the container, while facilitating disassembly and stowage, one-man portability, and minimal tool and skillset requirements for assemblage.

The present invention has been developed in response to the present state of the art, and in particular, in response to the problems and needs in the art that have not yet been fully solved by currently available containers. Accordingly, the present invention has been developed to provide a tote container which overcomes many or all of the above-discussed shortcomings in the art, the provided modular tote container comprising: a base panel having a planar bottom surface, the base panel comprising a plurality of upwardly-rising L-shaped brackets, the base panel defining a plurality of forward slots along a forward edge adapted to receive corresponding tabs on a front panel, the base panel defining a plurality of mid-slots adapted to receive tabs affixed to one or more dividers, the base panel defining a plurality of rearward slots; a pair of side panels defining a plurality of rectangular apertures adapted to receive the L-shaped brackets, the side panels adapted to detachably join with the base panel via the brackets; a pair of terminal panels comprising one or more inferiorly jutting tabs adapted to insert into slots on the base panel; one or more vertical dividers comprising one or more inferiorly jutting tabs adapted to insert into a slot on the base panel; whereby, the side panels, front panel, back panel and base panel collectively form a cavity within which items may be stowed; a lid adapted to dispose over the cavity.

Each bracket may comprise an L-shaped protuberance having a laterally-protruding cantilever superiorly positioned on the bracket adapted to detachably mate with an aperture of a side panel.

The base panel may comprise two or more slots adapted to receive a tab of a divider, in some embodiments. The side panels may each comprise a forward edge adapted to dovetail with a vertical socket recessed into a rearward edge of the front panel.

The front panel may define two socket recesses adapted to receive a forward edge of a side panel.

The forward edge of the side panel may comprise a plurality of pins in various embodiments. The lid may also comprise ribs and a plurality of snap locks. In various embodiments, the base panel and side panels comprise ribs.

The terminal panels may define a rectangular cutout. The base panel may define two or more intersecting slots.

In various embodiments, the base panel and side panels are hingedly affixed using a live hinge. In still further embodiments, the tote container comprises a plurality of lateral dividers defining a plurality of longitudinally-running grooves.

The slots defined by the base panel may be positioned superiorly to receptacles contouring the slots, the receptacles comprises a plurality of bottonies at terminal ends adapted to allow sidewalls of the receptacles to flex around inserted tabs.

A second modular tote container is provided comprising: a base panel having a planar bottom surface, the base panel comprising a plurality of upwardly-rising L-shaped brackets, each L-shaped brackets comprising a laterally-protruding cantilever superiorly positioned on the bracket adapted to detachably mate with an aperture of a side panel; the base panel defining a plurality of forward slots along a forward edge adapted to receive corresponding tabs on a front panel, the base panel defining a plurality of mid-slots adapted to receive tabs affixed to one or more dividers, the base panel defining a plurality of rearward slots; a pair of side panels defining a plurality of rectangular apertures adapted to receive the L-shaped brackets, the side panels adapted to detachably join with the base panel via the brackets; a forward panel comprising one or more inferiorly jutting tabs adapted to insert into slots on the base panel; a back panel comprising one or more inferiorly jutting tabs adapted to insert into slots on the base panel; one or more vertical dividers comprising one or more inferiorly jutting tabs adapted to insert into a slot on the base panel; whereby, the side panels, front panel, back panel and base panel collectively form a cavity within which items may be stowed; a lid adapted to dispose over the cavity comprises ribs and gussets.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1:
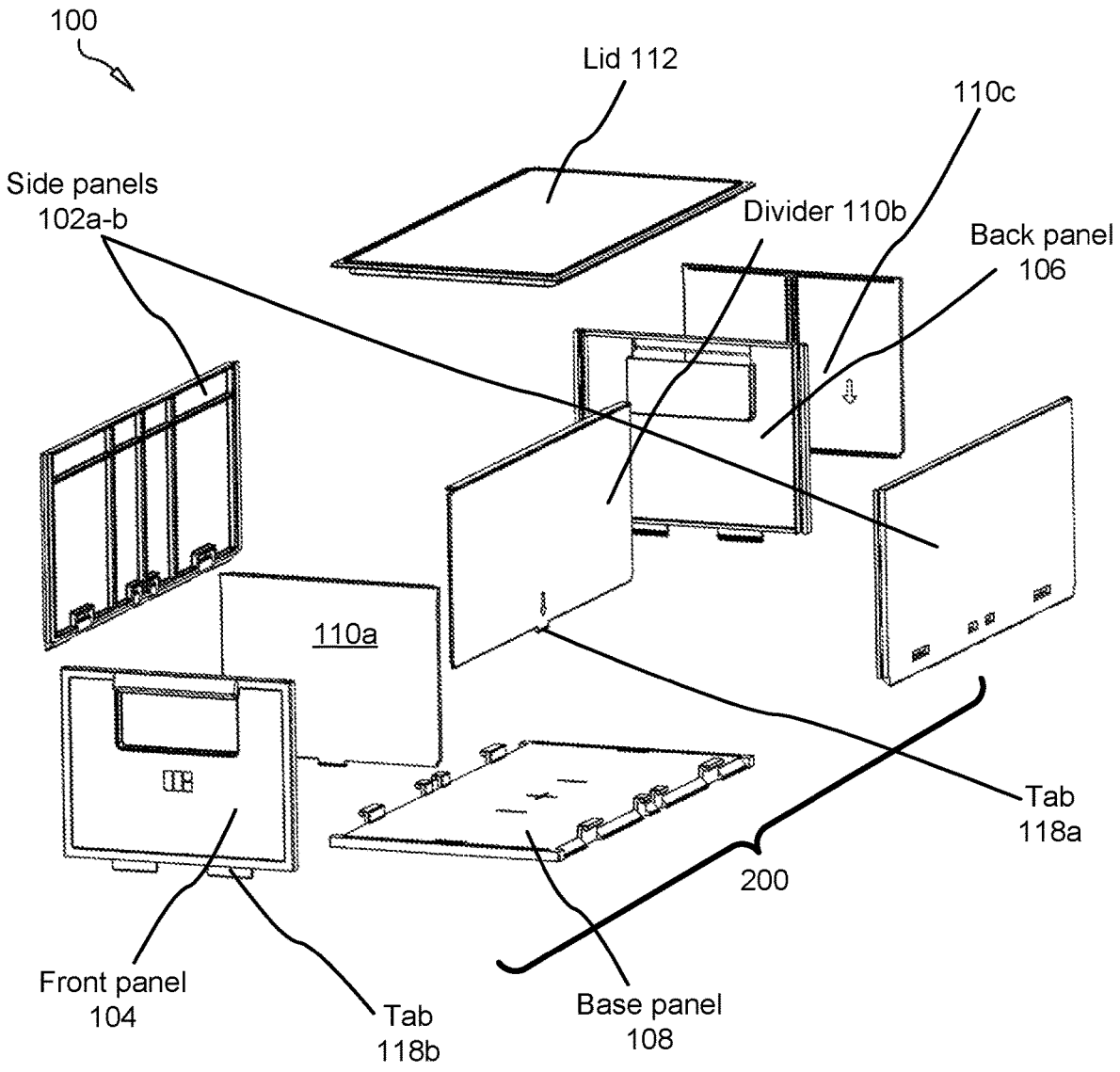
FIG. 1 is an exploded, modular tote container in accordance with the present invention.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method.

Additionally, the order in which a particular method occurs may or may not strictly adhere to the order of the corresponding steps shown.

Component items in the drawings indicated with letters following numerals, such as 102*a* and 102*b*, indicate multiple instances of the same component, or mirror duplicates of the same component.

FIG. 1 is an exploded, modular tote container 100 in accordance with the present invention. The container 100 comprises a base panel 108, a side panel 102*a*, a side panel 102*b*, a front panel 104, a back panel 106, a lid 112, and three dividers 110*a-c*.

The container 100 forms a substantially cubic shape and may be formed from suitable materials for the containers including, without limitation, wood, wood pulp, polymers, polyurethane, polyvinyl chloride, polyethylene, aluminum, and metal alloys.

The dividers 110 form substantially rectangular shapes with planar surfaces and may vary in width but are adapted to span the width of the interior cavity 314 created within the container 100 by the base panel 108, the side panels 102, front panel 104, and back panel 106. The partition/dividers 110 are detachable and easy to reposition, allowing the user to create different quantities and sizes of bins 702. The dividers 110 (or vertical dividers 110) are disposed perpendicularly, or orthogonally, to the base panel 108. The vertical dividers 110 can be manipulated to create differently sized bins 702.

Figure 2:
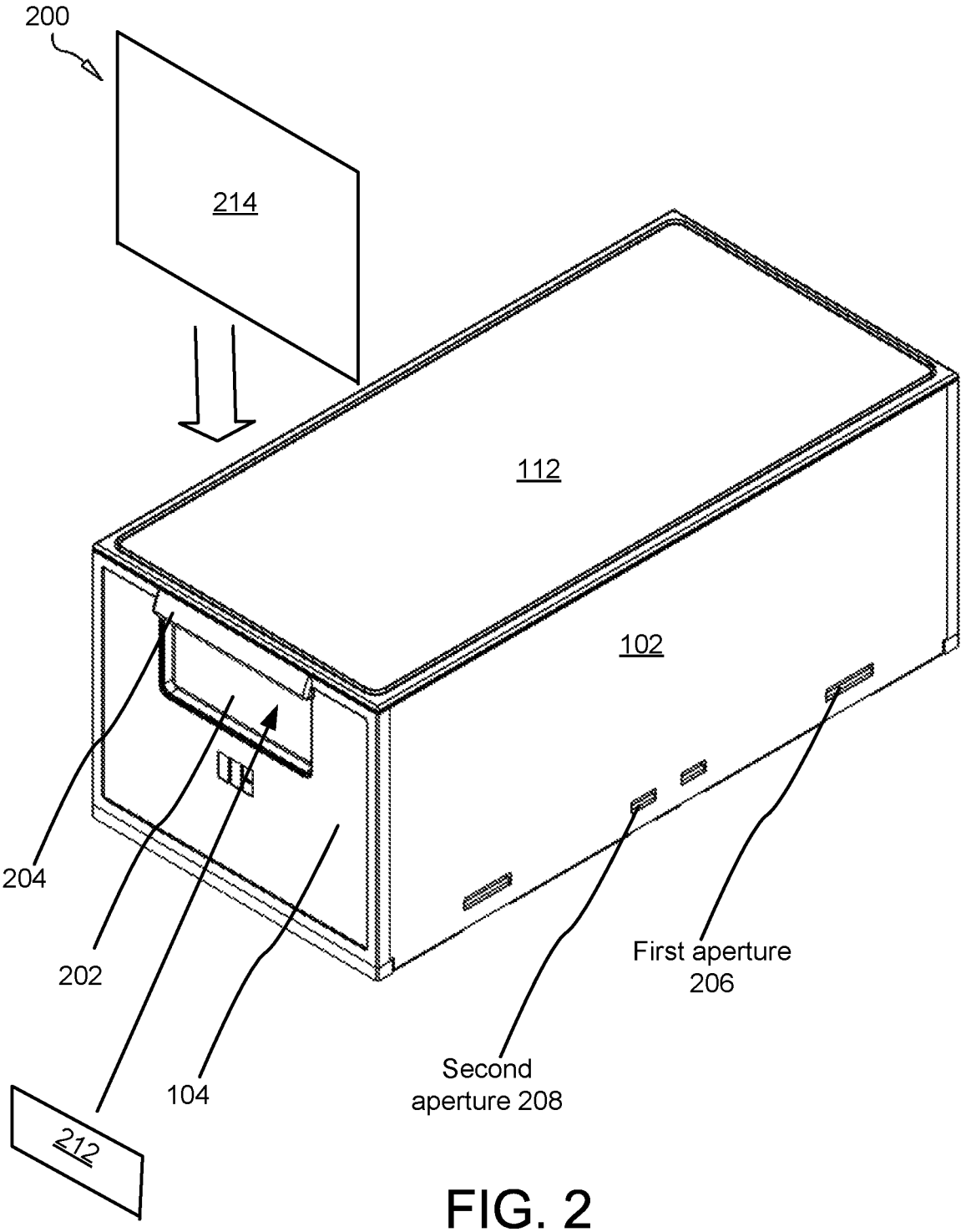
FIG. 2 is an isometric view of a modular tote container in accordance with the present invention.

FIG. 2 is an isometric view of a modular tote container 200 in accordance with the present invention.

The forward panel 104 defines a rectangular cutout recess 202 which may be gripped with the finger or hands of a user. A lip 204, or handle, disposes above a cutout recess 202. The lip 204 juts forwardly allowing the tips of fingers to be inserted beneath it for applying lifting and pulling forces to the apparatus 200.

In various embodiments, the recess 202 traverses the forward panel 104. The divider 110 disposed behind the forward panel 104 may in some embodiments, and not in other embodiments, be visible through the recess 202. The purpose of the recess 202 is to allow the visual appearance of the tote container 200 to be customized by a user. In some embodiments, a user applies a label 212 onto the exposed, planar surface within the recess 202; but, in the preferred embodiment, the user insert paper(s) 214 into a recess 202 formed between the front panel 104 and the divider 110 further described below in relation to FIG. 20.

The forward panel 104 and rearward panel (or back panel 106) may be identical. Because the front panel 104 (or forward panel 104) and the back panel 106 may be identical and positioned at terminal ends of the container 100, these panels 104, 106 may be referred to hereinafter as "terminal panels." The forward panel 104 comprises one or more downwardly jutting, or inferiorly protruding, tabs 118 which insert into corresponding slots 422 positioned along a forward edge 424 of the base panel 108 and/or the rearward edge of the base panel 108.

Figure 3:
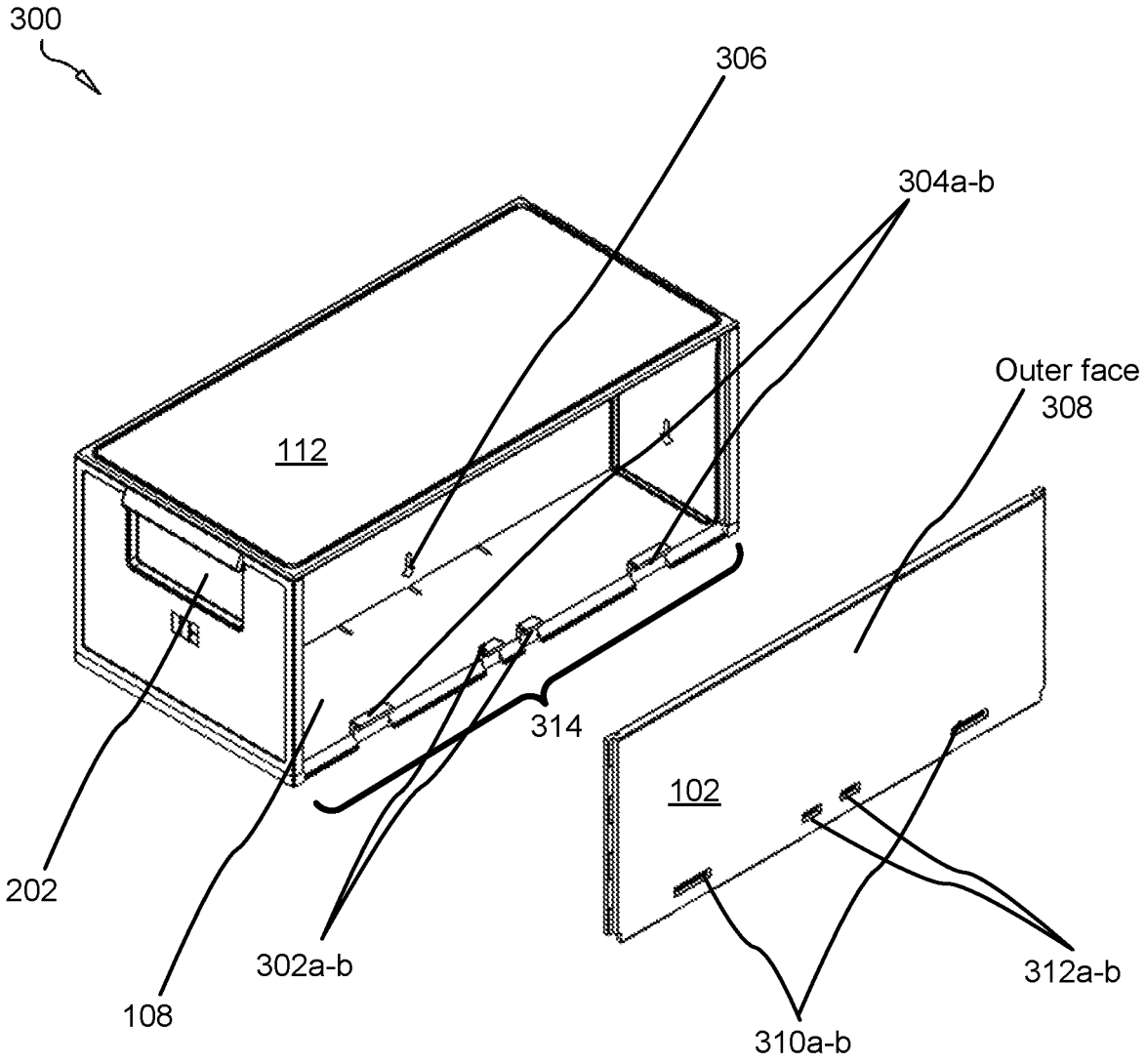
FIG. 3 is a partially exploded, modular tote container in accordance with the present invention.

FIG. 3 is a partially exploded, modular tote container 300 in accordance with the present invention.

The base panel 108 comprises a plurality of first L-shaped brackets 302 and a plurality of second L-shaped brackets 304 further described below.

The sidewalls 102 define a plurality of rectangular apertures 310, 312 dimensioned to receive the cantilevers 904 of the brackets 302, 304. The sidewalls 102 join with the base panel 108 vis-à-vis the brackets 302, 304.

Arrows 306 may be engraved or defined in relief on the dividers 110 and/or other components 102, 104, 106 of the container 100.

Figure 4A:
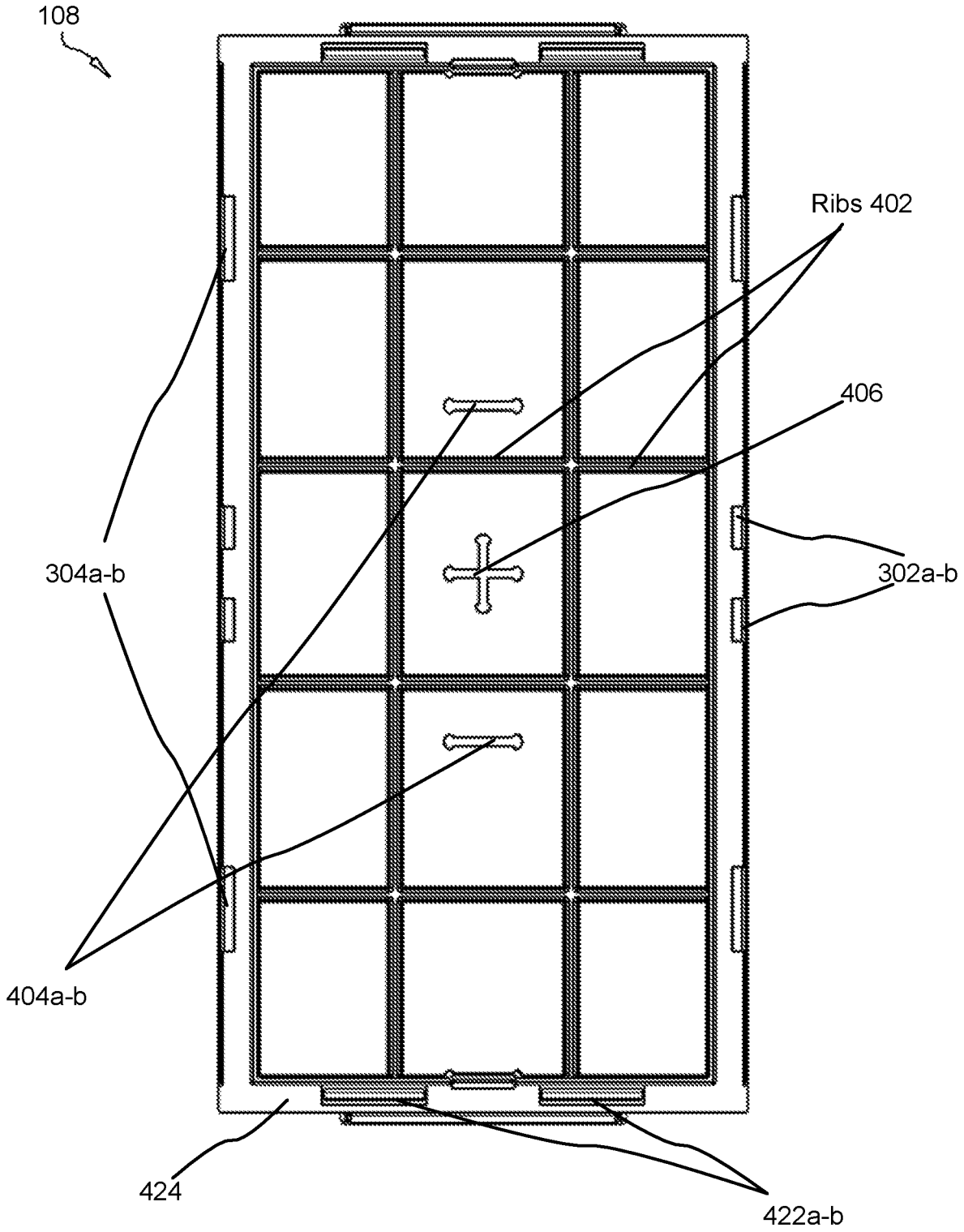
FIG. 4A is an upper perspective view of the base panel of a modular tote container in accordance with the present invention.

FIG. 4A is an upper perspective view of the base panel of a modular tote container in accordance with the present invention.

Ribs 402 are useful for stowing items and providing structural integrity to the assembly 100. Ribs 402 may crisscross, or form a lattice, on the upper surface of the base panel 108 to add strength and rigidity to the base panel 108. The base panel 108 defines a plurality of slots 404, 406, and 422 adapted to receive tabs 118 descending from the side panels 102 and/or the forward panel 104 and/or the back panel 106. The slots 404 may intersect forming a slot 406.

Figure 4B:
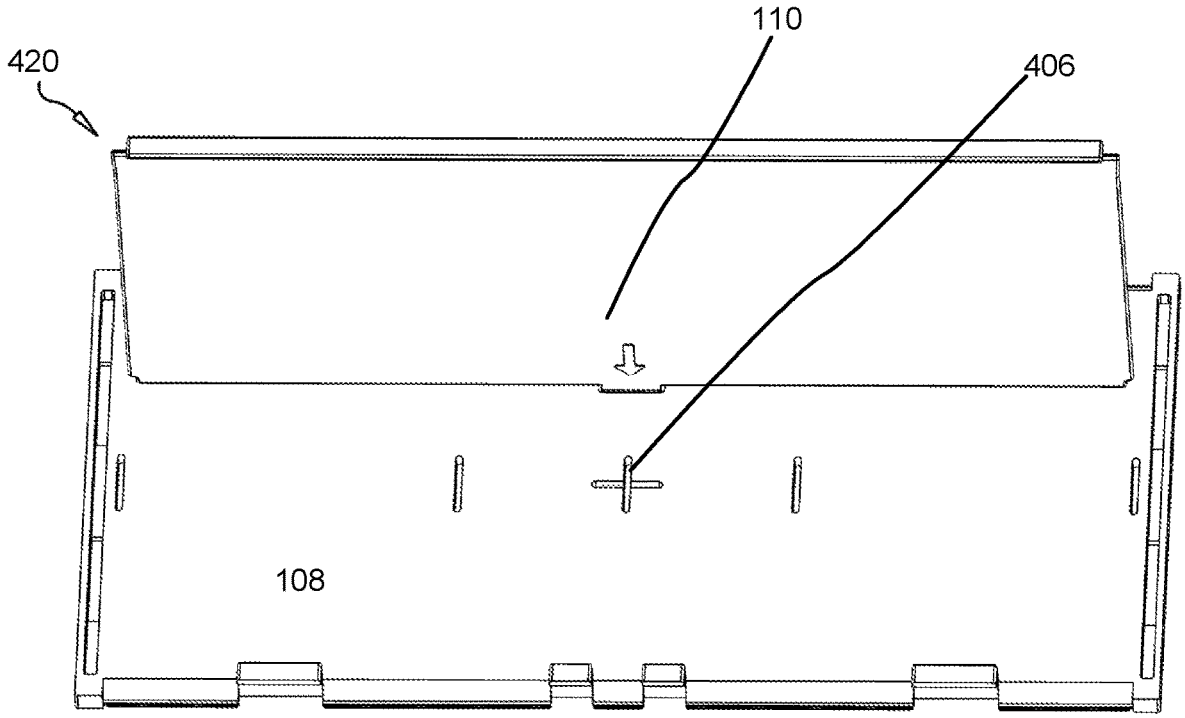
FIG. 4B is an upper perspective view of the base panel and divider of a modular tote container in accordance with the present invention.

FIG. 4B is an upper perspective view of the base panel and divider of a modular tote container 420 in accordance with the present invention.

The slots 406 may appear as linear grooves or plus-shaped grooves from an upper perspective. In various embodiments, the slots 406 do not penetrate the base panel 108 entirely, but rather are enveloped inferiorly below the planar inner surface of the base panel by receptacles 444 adapted to receive tabs 1702.

Figure 4C:
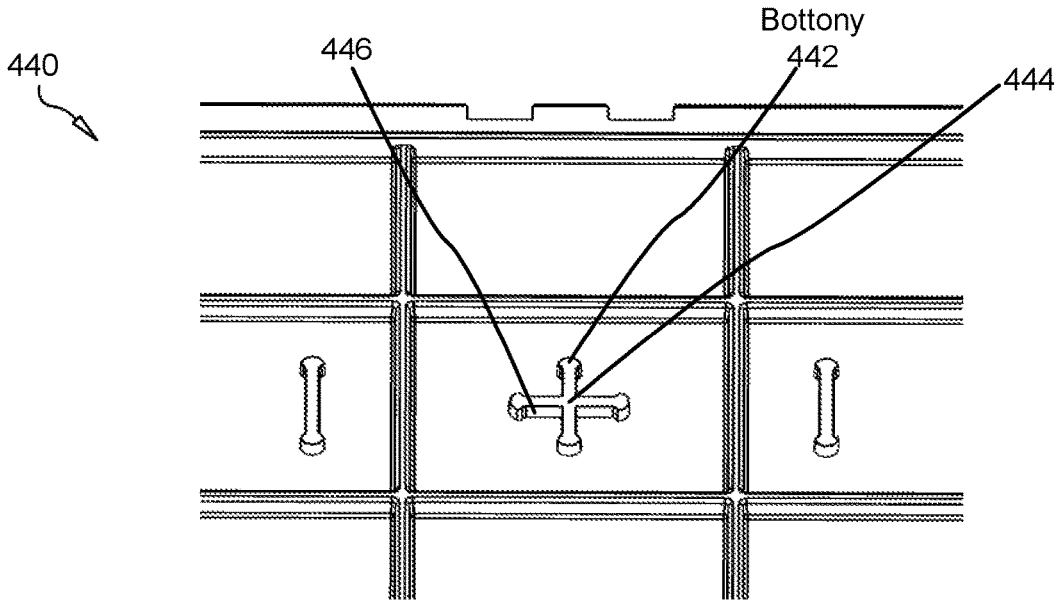
FIG. 4C is a lower perspective view of the base panel of a modular tote container in accordance with the present invention.

FIG. 4C is a lower perspective view of the base panel of a modular tote container 440 in accordance with the present invention.

The receptacles 444 roughly contour the slots 406 inferiorly, forming interior tab recesses adapted to receive the tabs 1702. The tab recesses may flare at terminal ends of the slots 406 within bottonies 442 forming the receptacles 444. The flared nature of the tab recesses within the bottonies allows sidewalls 446 of the receptacles 444 to flex around a tab 1702 inserted into the slot 406 and the receptacle 444 and are adapted to allow the receptacle 444 to lock the tab 1702 in place.

Figure 5:
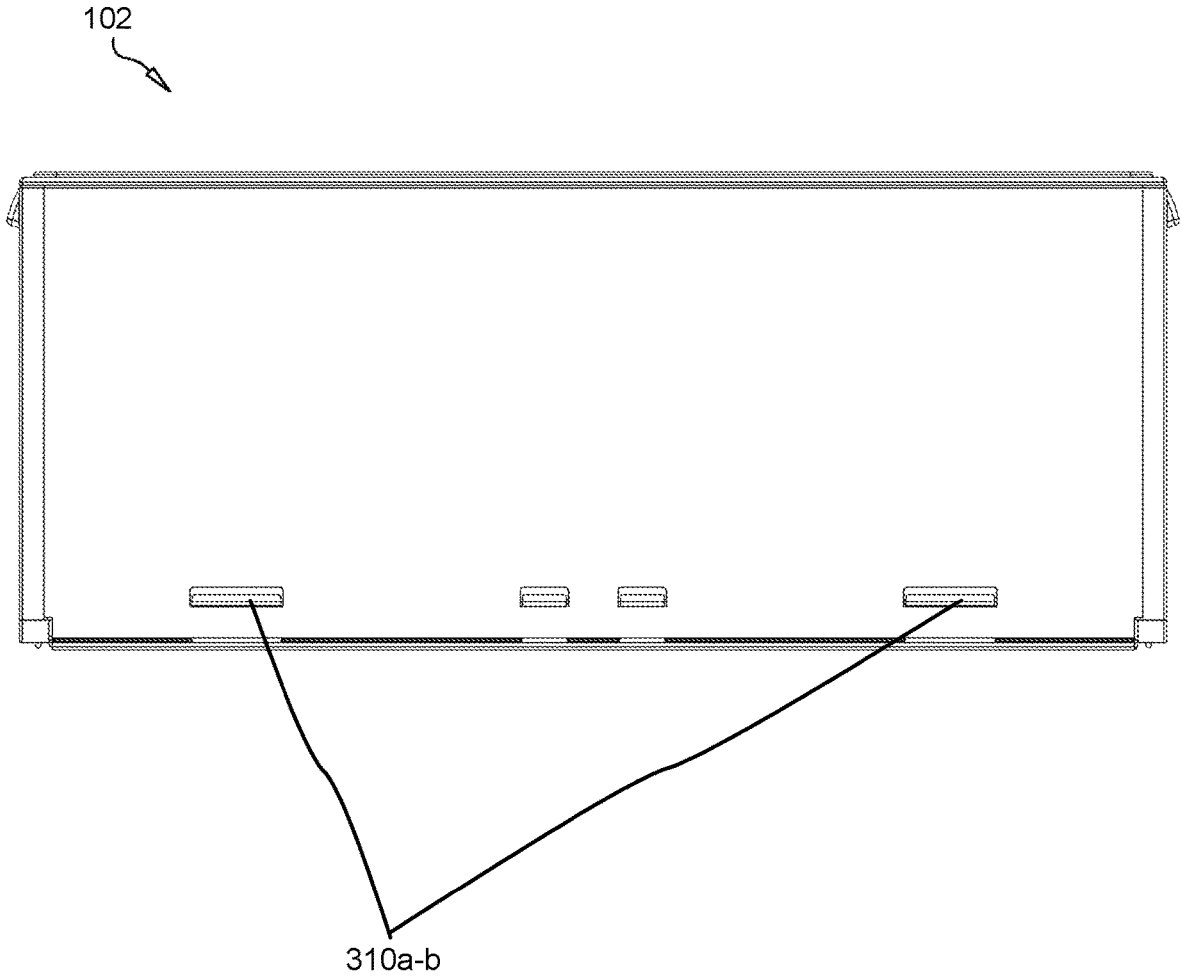
FIG. 5 is a side perspective view of a side panel of a modular tote container in accordance with the present invention.

FIG. 5 is a side perspective view of a side panel of a modular tote container in accordance with the present invention.

As shown.

Figure 6:
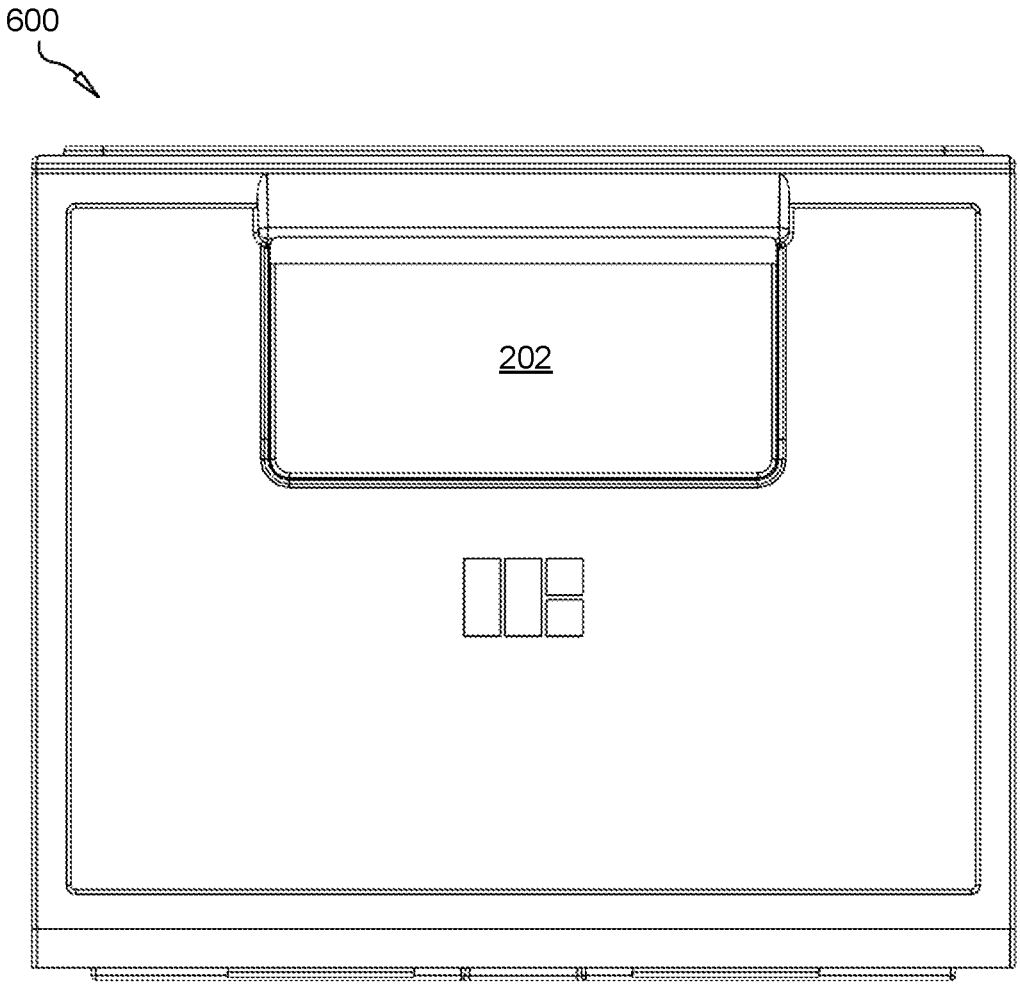
FIG. 6 is a forward perspective view of a modular tote container in accordance with the present invention.

FIG. 6 is a forward perspective view of a modular tote container 600 in accordance with the present invention.

As shown.

Figure 7A:
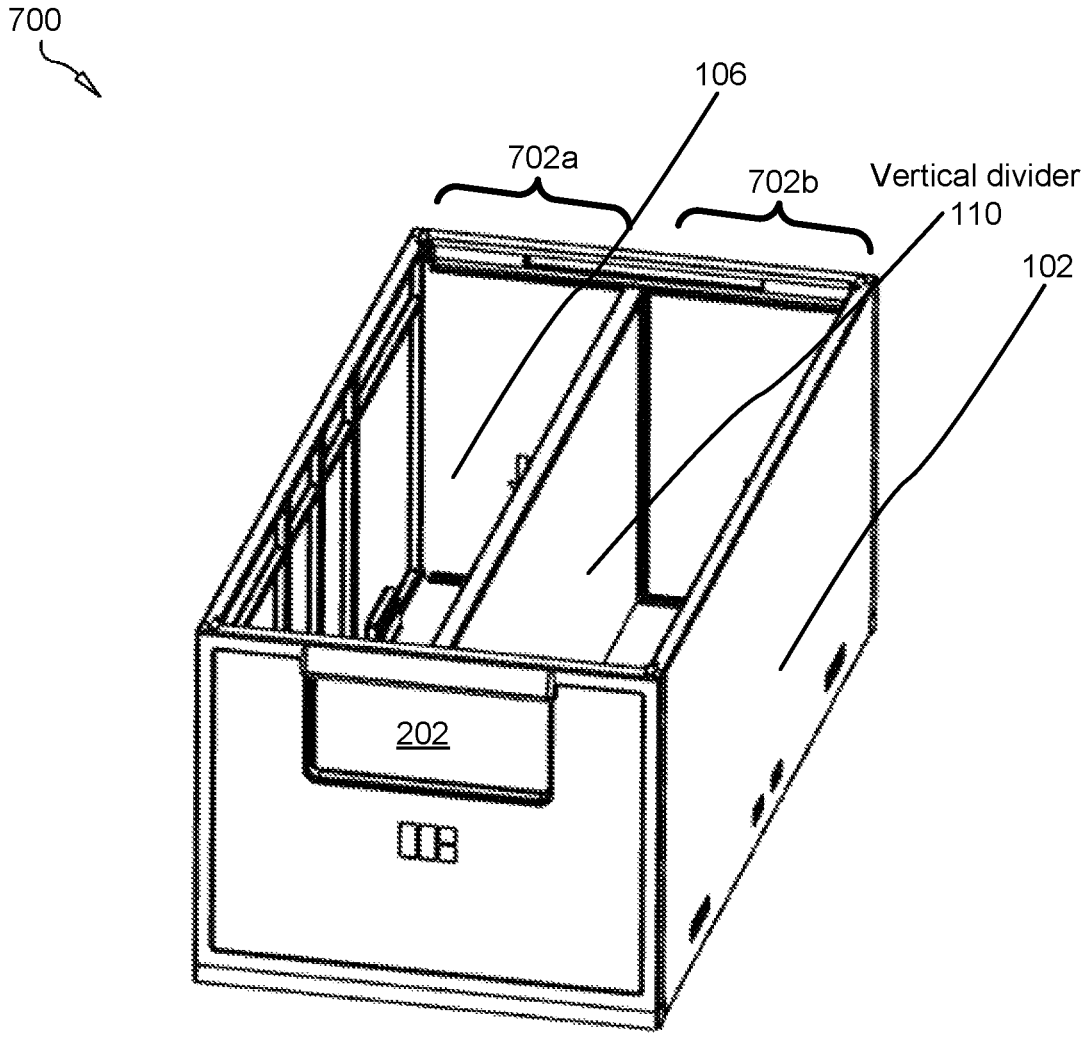
FIG. 7A is a sectioned upper, forward perspective view of a modular tote container in accordance with the present invention.

FIG. 7A is a sectioned upper, forward perspective view of a modular tote container 700 in accordance with the present invention.

A plurality of bins 702 are defined by the surrounding components 102*a-b*, 104, 106, 108 along with the divider 110.

Figure 7B:
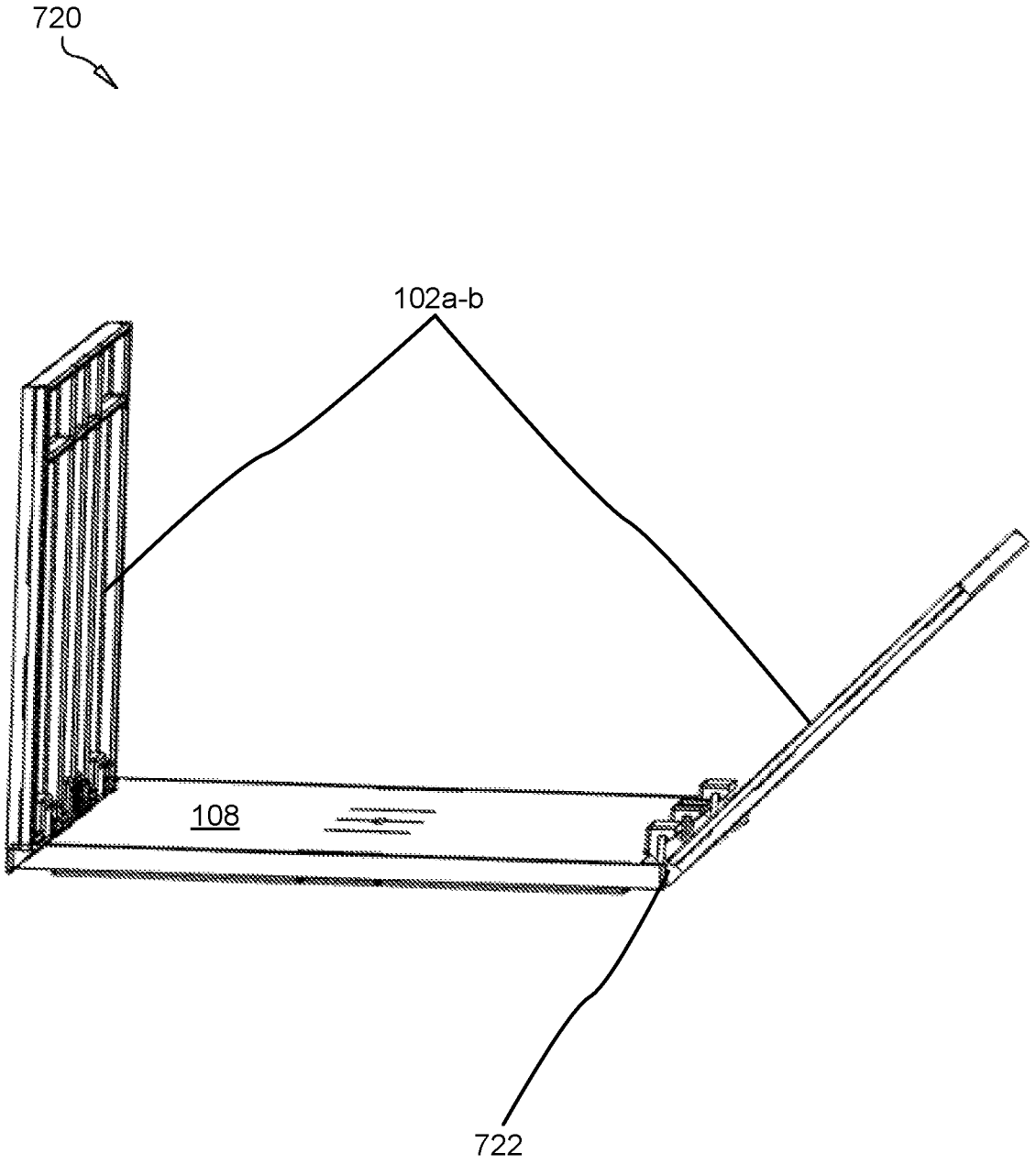
FIG. 7B is a forward perspective view of a modular tote container in accordance with the present invention.
Figure 7C:
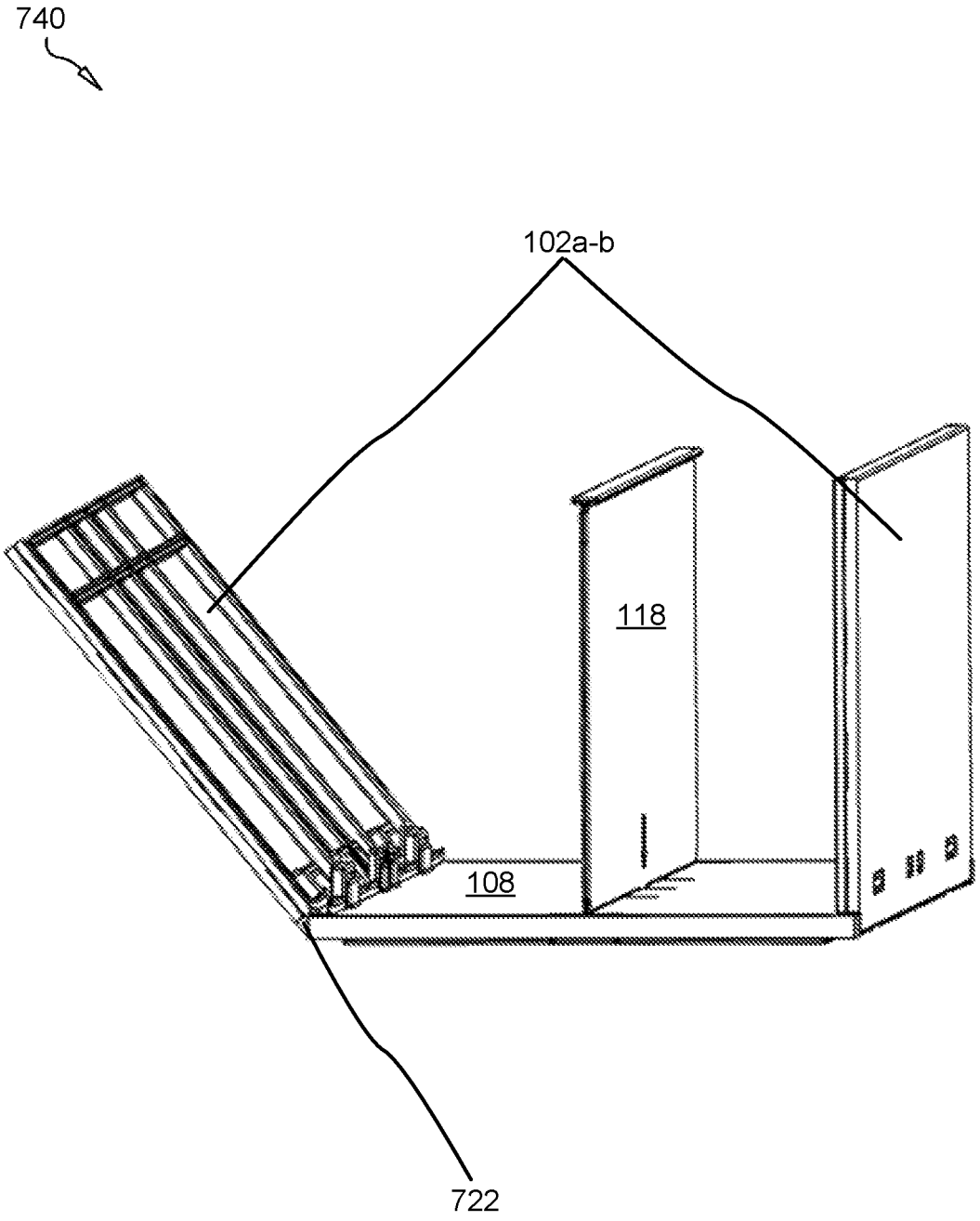
FIG. 7C is a forward perspective view of a modular tote container in accordance with the present invention.
Figure 7D:
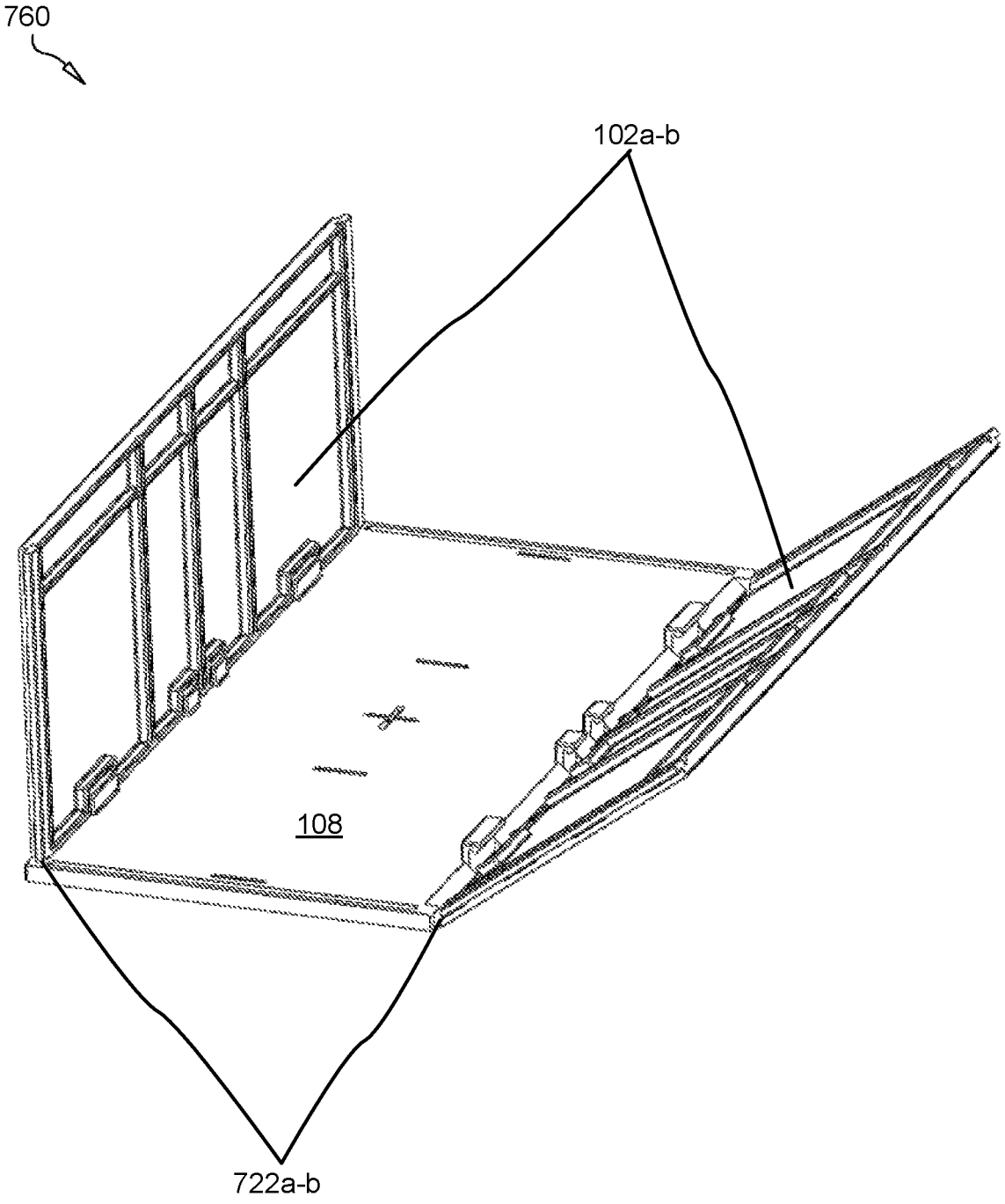
FIG. 7D is a forward perspective view of a modular tote container in accordance with the present invention.

FIG. 7B-7D illustrate forward perspective views of modular tote containers 720-760 in accordance with the present invention.

In various embodiments, the side panels 102 and the base panel 108 are formed as a single integrated piece with a live hinge 722 interconnecting the base panel 108 and the side panels 102. A "live hinge" or "living hinge" is a thin, flexible hinge made from the same materials as the two pieces it interconnects which is adapted to bend along the hinge making it use packaging the pieces flat and raising the side panels 102 into place alongside the base panel 108.

Figure 8:
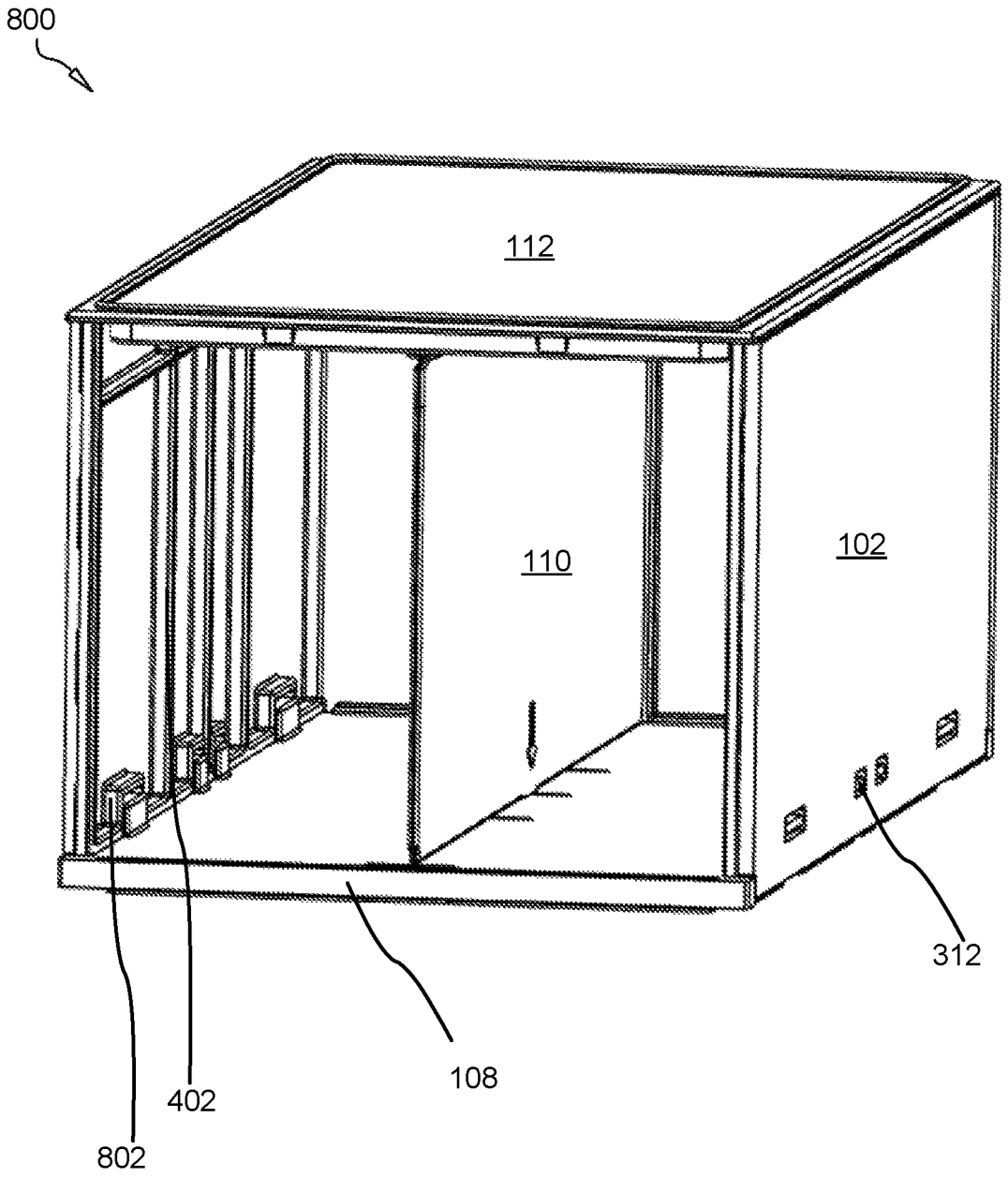
FIG. 8 is a sectioned forward perspective view of a modular tote container in accordance with the present invention.

FIG. 8 is a sectioned forward perspective view of a modular tote container in accordance with the present invention.

The apertures 310 are circumscribed on the side panels 102 by sidewalls 802 which interlock into the track 908 of the bracket 302, 304.

Figure 9:
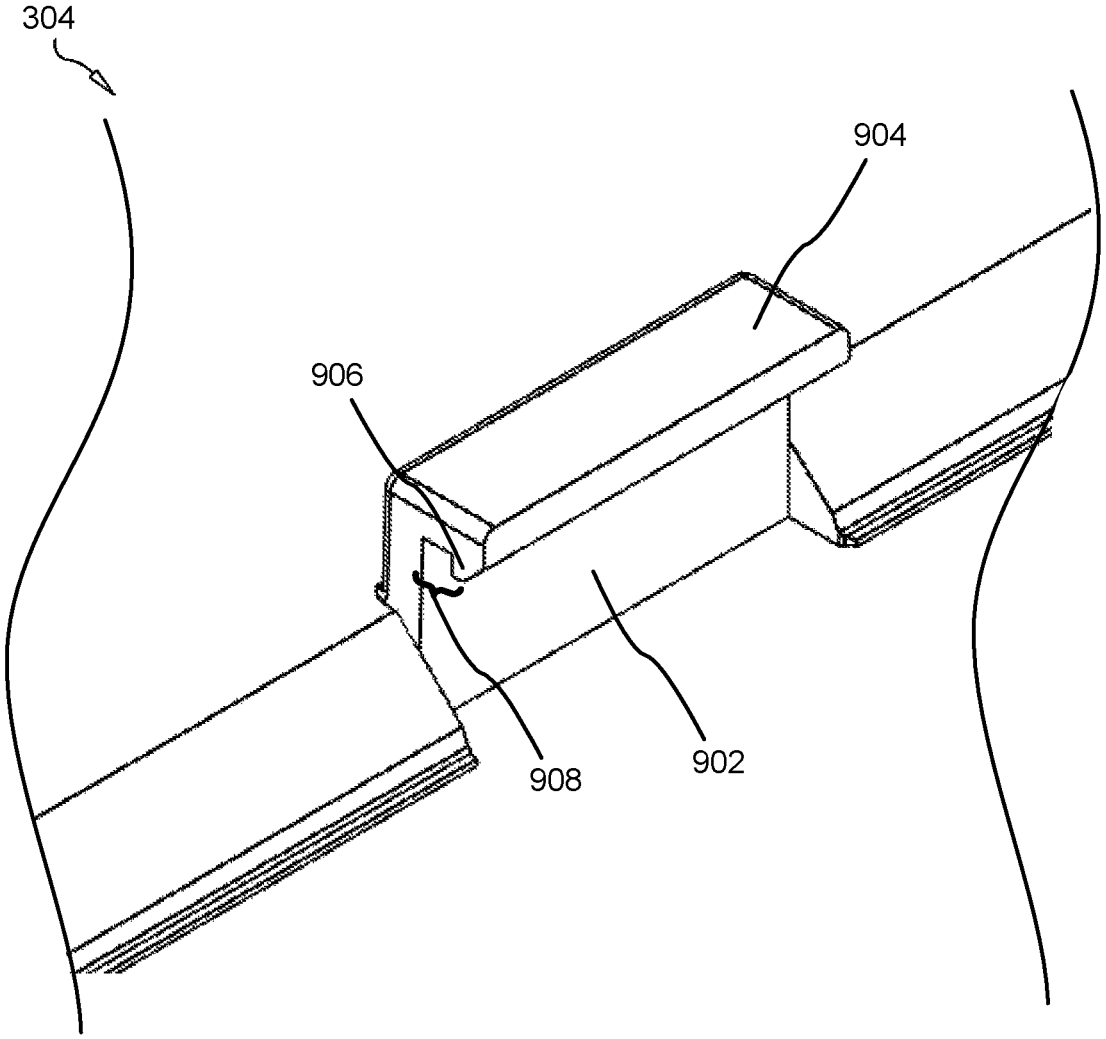
FIG. 9 is a zoomed view perspective view of a bracket of a base panel of a modular tote container in accordance with the present invention.

FIG. 9 is a zoomed view perspective view of a bracket of a base panel of a modular tote container in accordance with the present invention.

Each bracket 302, 304 comprises a superiorly-rising protuberance 902 and outwardly, laterally-protruding cantilever 904. The outer edge of the cantilever 904 comprises an inferiorly-descending lip 906. The lip 906, cantilever 904, and protuberance 902 define a track 908, or recess. The brackets 302, 304 interlock with corresponding rectangular apertures 310, 312 on the side panels 102.

The dividers 110 may arranged in a parallel, spaced-apart relationship that forms bins 702 within the cavity 314 and enables items (or materials) of a user to be organized within the container 100. The dividers 110 may comprise simple flat panels having downwardly-protruding tabs 118 which engage slots 404, 406 defined by an upper surface 428 of the base panel 108.

The detachably arrangement between components 108, 102, 104, 106, enables the container 100 to form a rigid compartment, or box, which can be easily stacked upon other containers 100, removed, collapsed, stowed and ported.

The containers 100, 300, 700 are dimensioned to support items, such as papers, files, books, ornamentals, and crafting materials.

The side panels 102, in alternative embodiments, may hingedly join with the base panel 108 and fold upon each other for ease of storage. In this manner, the side panels 102 may pivotably articulate between an open, upwardly-protruding position and a horizontal, folded position.

In the open position the side panels 102, front panel 104, and back panel 106, extend linearly and upwardly from the perimeter edges of the base panel 108.

Consistent with the modular configuration of the assembly 100, all of the substantially planar components of the container 100 detach and attach using interlocking tabs 118; brackets 302, 304; and apertures 310, 312, 422, all of which are easily manufactured using plastic infection molding or stamped from polymeric sheets.

As discussed above, the container 100 is mobile. This mobility allows the container to be moved from room-to-room and shelf to shelf, and to be arranged in a desired workstation configuration. The ribs 402 and other structural components allow a plurality of laden containers 100 to be stacked one upon another.

The assemblage of the container 100 is relatively easy, requiring minimal skill sets and tools. In operation, the container 100 providers a practical apparatus which overcomes deficiencies in the art, consisting of a relatively small number of components adapted to be arranged in basic geometries for bin(s) 702.

Figure 10:
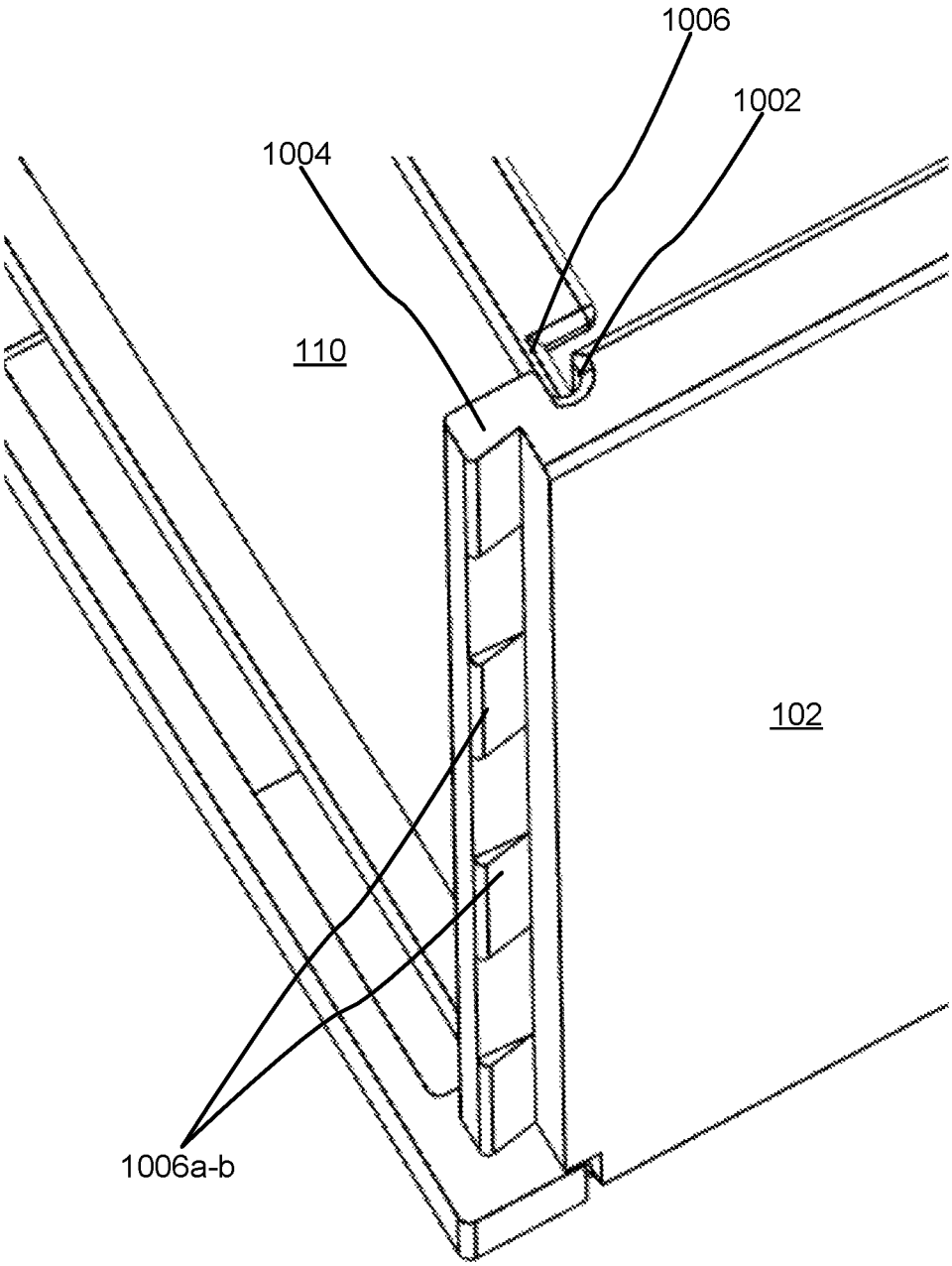
FIG. 10 is a zoomed view perspective view of the edge of a modular tote container in accordance with the present invention.

FIG. 10 is a zoomed view perspective view of the edge of a modular tote container in accordance with the present invention.

The side panels 102 define a plurality of vertical tracks 1002 within which edges 1006 of the dividers 110 run. These edges 1006 may be tapered or narrowed in thickness. A plurality of vertical tracks 1002 may position at regularly-spaced intervals across a width of the side panel 102, including at a forward edge and rearward edge.

The side panel 102 comprises a forward edge 1004 inclined inwardly to dovetail with a track, or socket, recessed into the front panel 104 along lateral edges of the front panel 104. The forward edge 1004 may be fluted, and may comprise a series of pins 1006 which joint with a tail track 1002 recessed into a rearward surface of the front panel 104, forming a sliding dovetail joint at a right angle.

Figure 11:
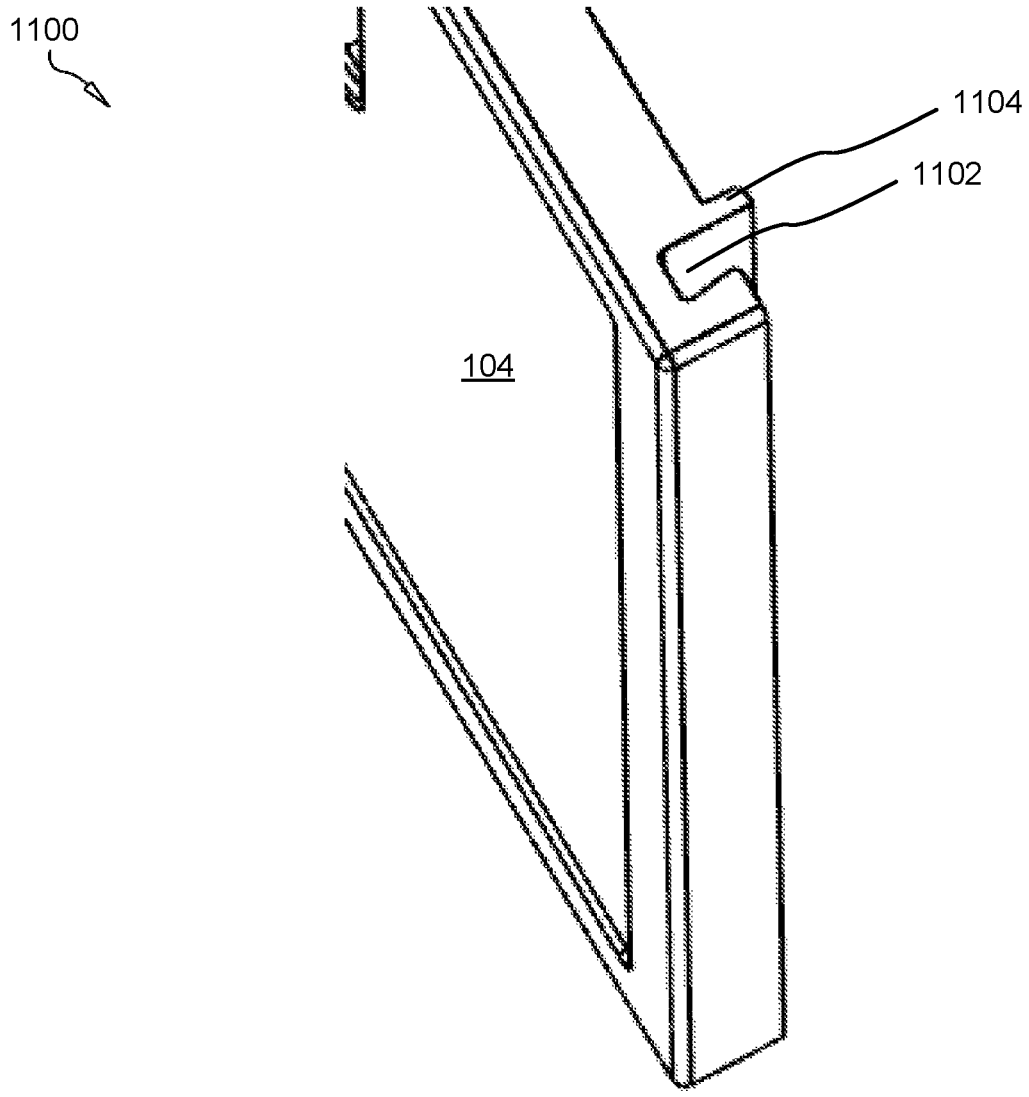

FIG. 11 is a zoomed view perspective view of the edge of a forward panel of a modular tote container 1100 in accordance with the present invention.

The tail socket 1102, or track, is indicated on the rearward surface of the front panel 104. The track 1102, or groove 1102, dovetails with the forward edge 1104 and pins 1106 of the side panels 102. In some embodiments, a stabilizing lip extends longitudinally adjacent to the track 1102 across the height of the front panel 104.

Figure 12:
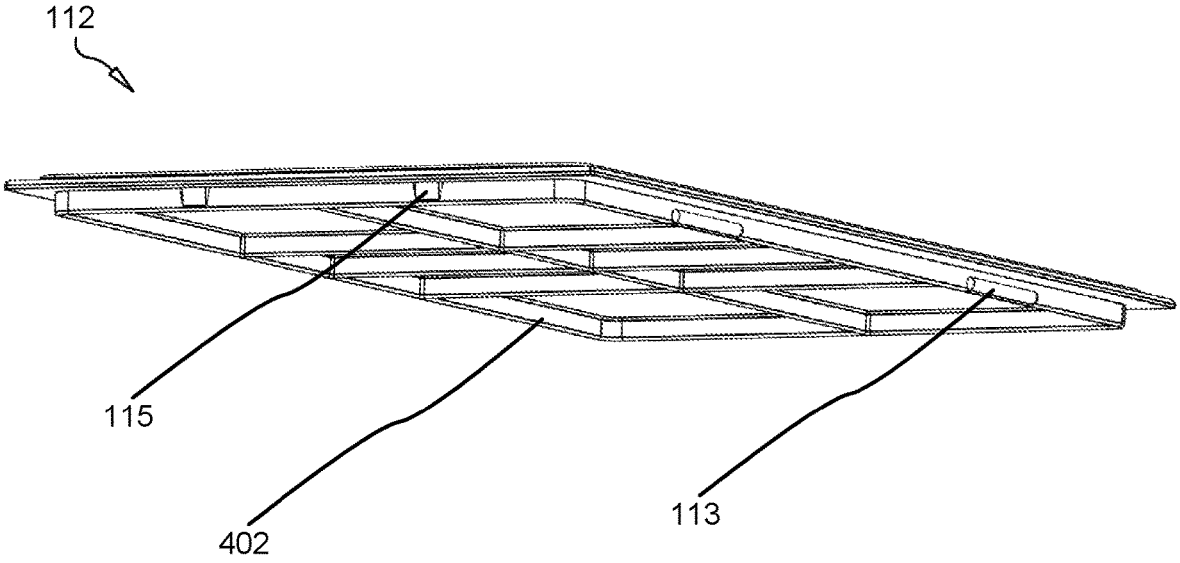
FIG. 12 is a zoomed view perspective view of a lid of a modular tote container in accordance with the present invention.
Figure 13:
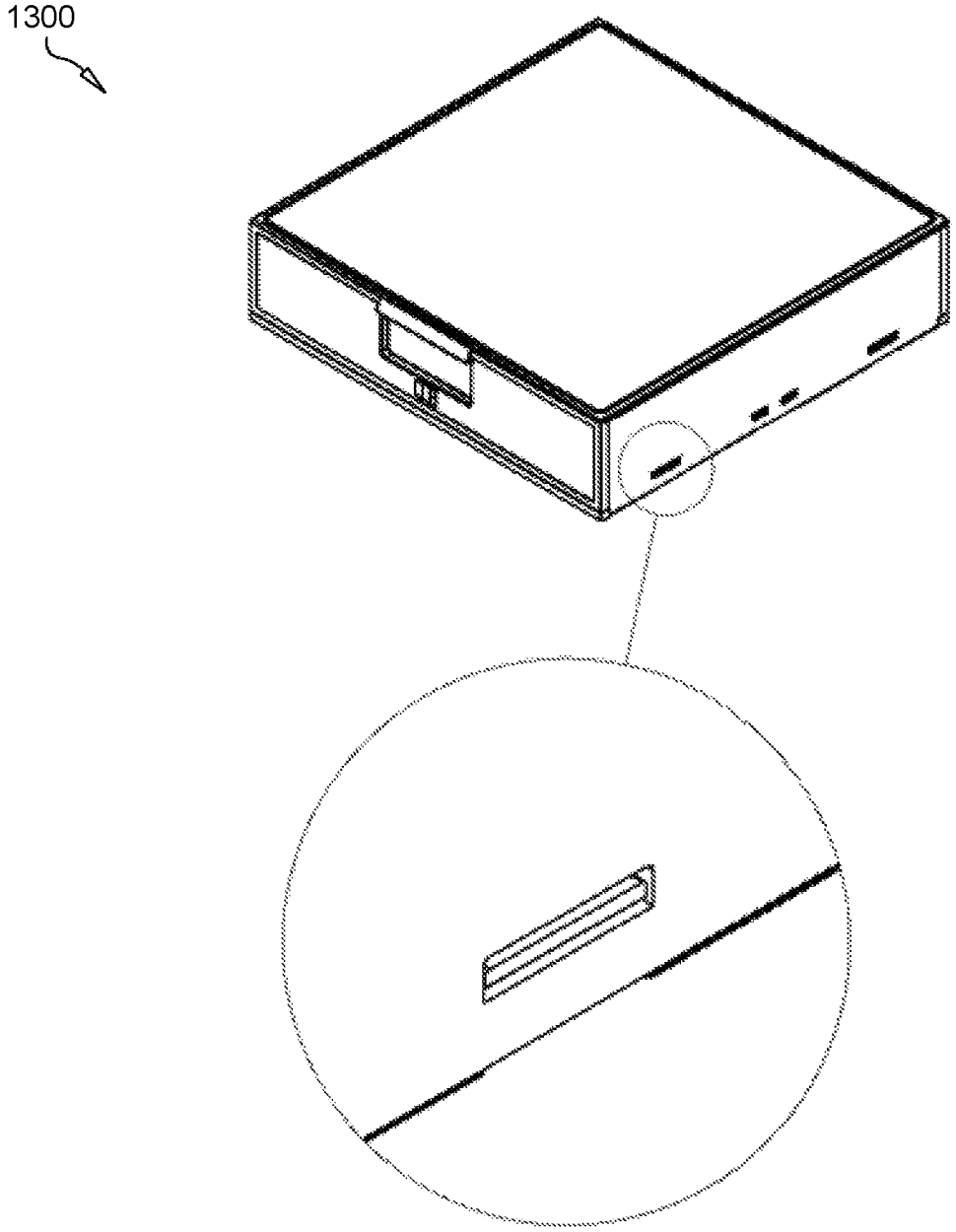
FIG. 13 illustrates a modular tote container in accordance with the present invention.
Figure 14:
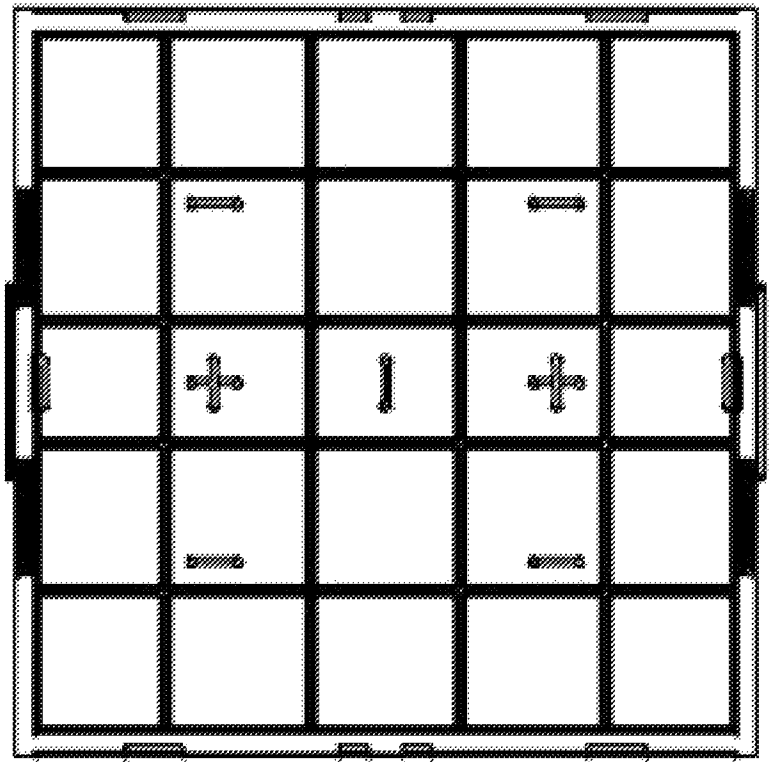
FIG. 14 illustrates a lower perspective view of a modular tote container in accordance with the present invention.
Figure 15:
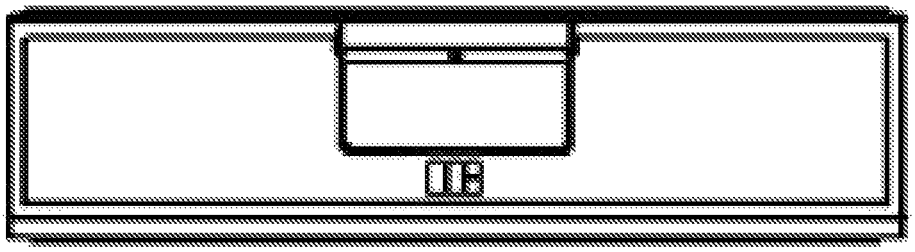
FIG. 15 illustrates a forward perspective view of a modular tote container in accordance with the present invention.
Figure 16:
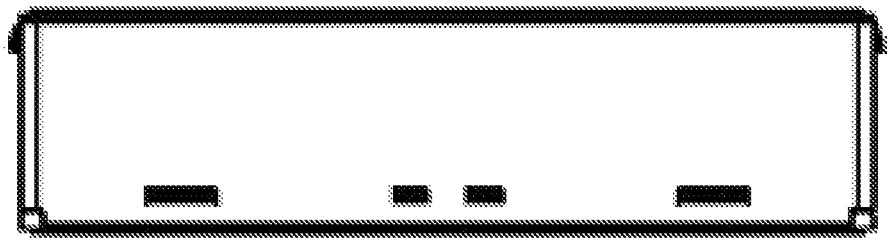
FIG. 16 illustrates a side perspective view of a modular tote container in accordance with the present invention.
Figure 17:
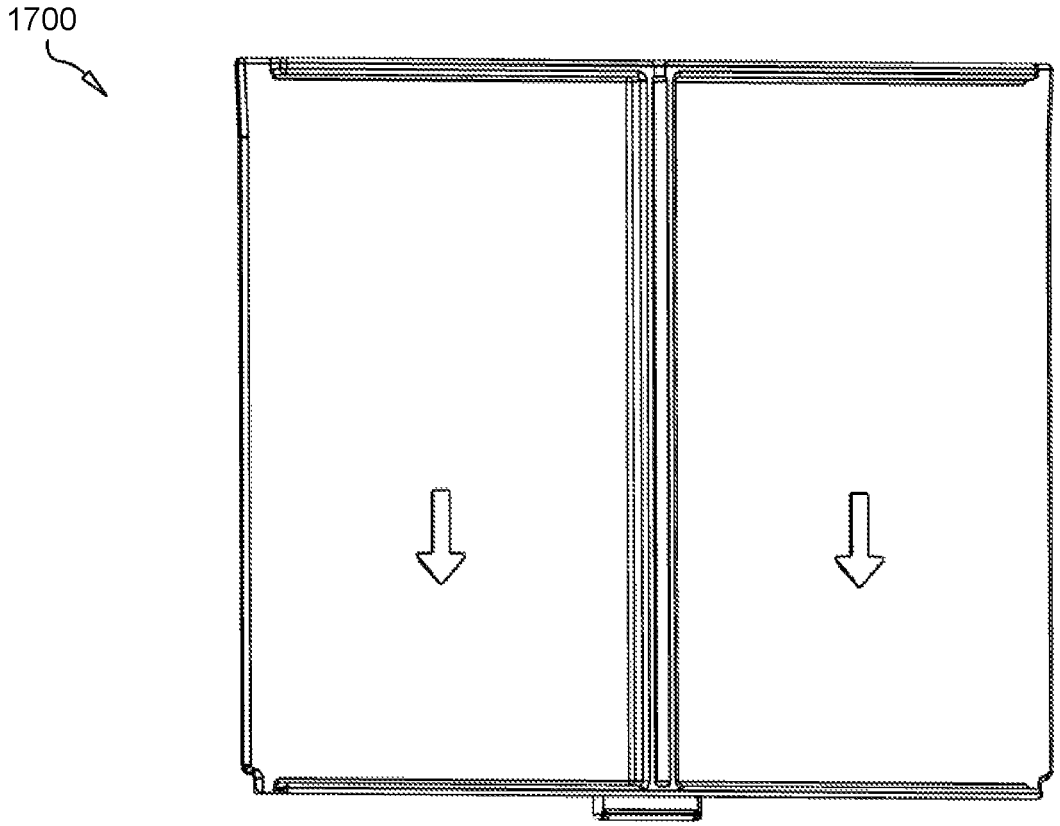
FIG. 17 illustrates a top perspective view of a modular tote container in accordance with the present invention.
Figure 18:
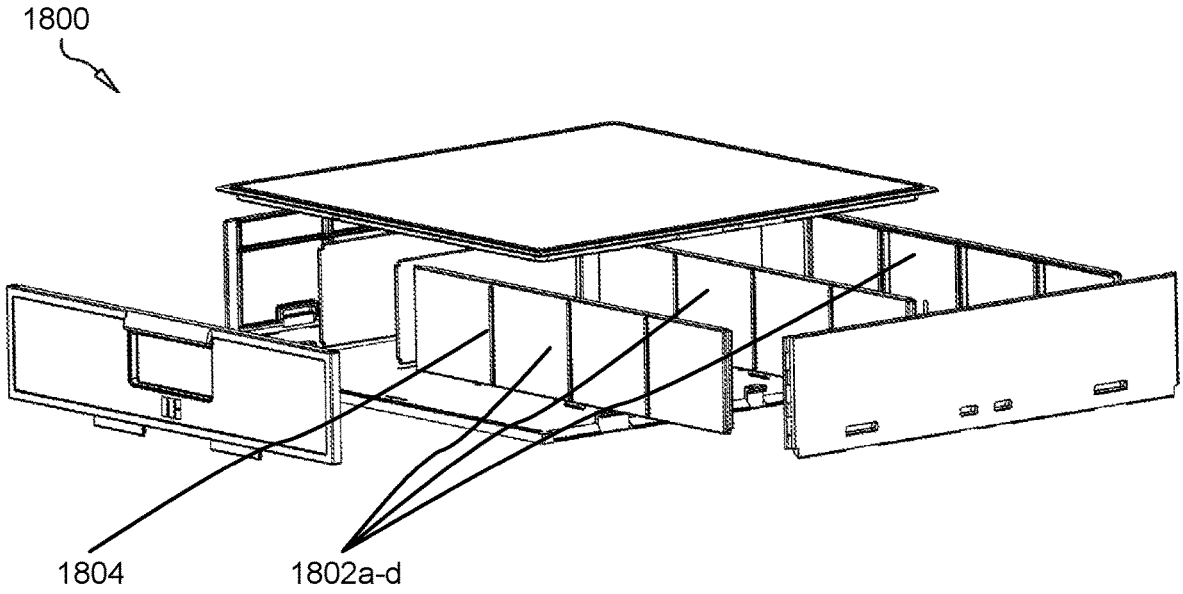
FIG. 18 illustrates an exploded view of a modular tote container in accordance with the present invention.
Figure 19:
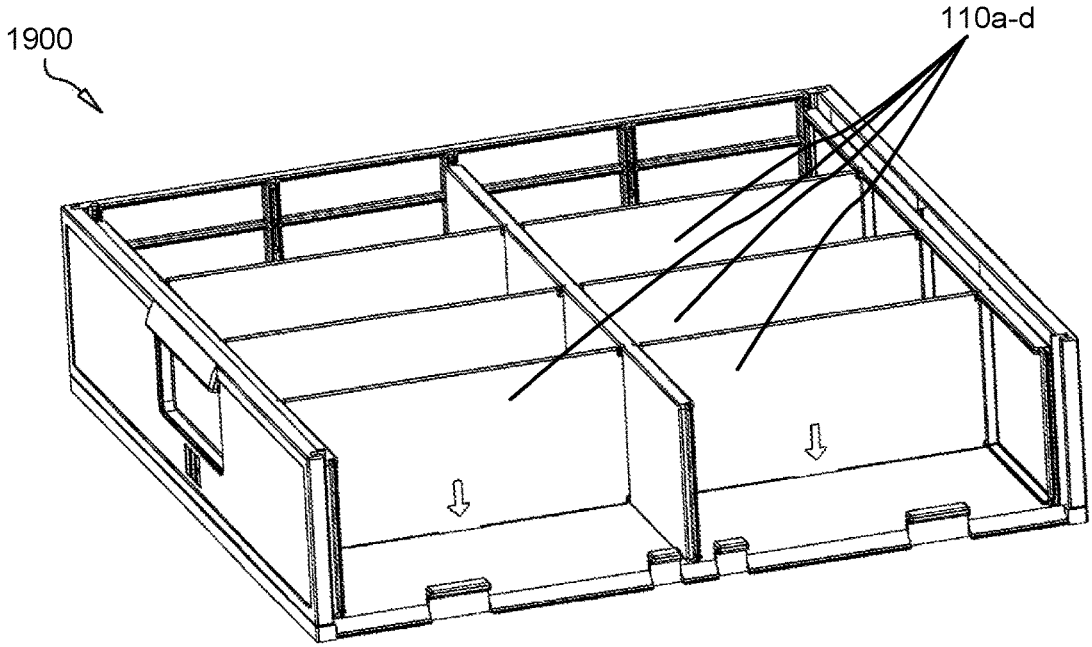
FIG. 19 illustrates an exploded view of a modular tote container in accordance with the present invention.

FIG. 12 illustrates a lid 112 of a modular tote container 100 in accordance with the present invention. The lower surface of the lid 112 comprises a plurality of crisscrossing ribs 402. The outer edges of the ribs 402 may comprise gussets 115 for the purpose of positioning the lid 112 and/or a plurality of snap locks 113 adapted to form snap fits with an upper edge of the side panels 102.

FIGS. 13-19 illustrates modular tote containers 1300-1900 in accordance with the present invention.

In various embodiments, the tote container 1300-1900 may be dimensioned to be receive multiple dividers 110, 1802 as shown. The tote container 800 may contain lateral dividers 1802 which may define a plurality of longitudinally-running grooves or tracks 1804 adapted to receive the edges of dividers 110.

Tabs 1702 jut inferiorly from the dividers 1700, 110, which tabs 1702 are adapted to insert into the slots 406 and receptacles 444. These tabs 1702 comprise linear protuberances running in parallel with the planar faces of the divider 1700, 110.

Figure 20:
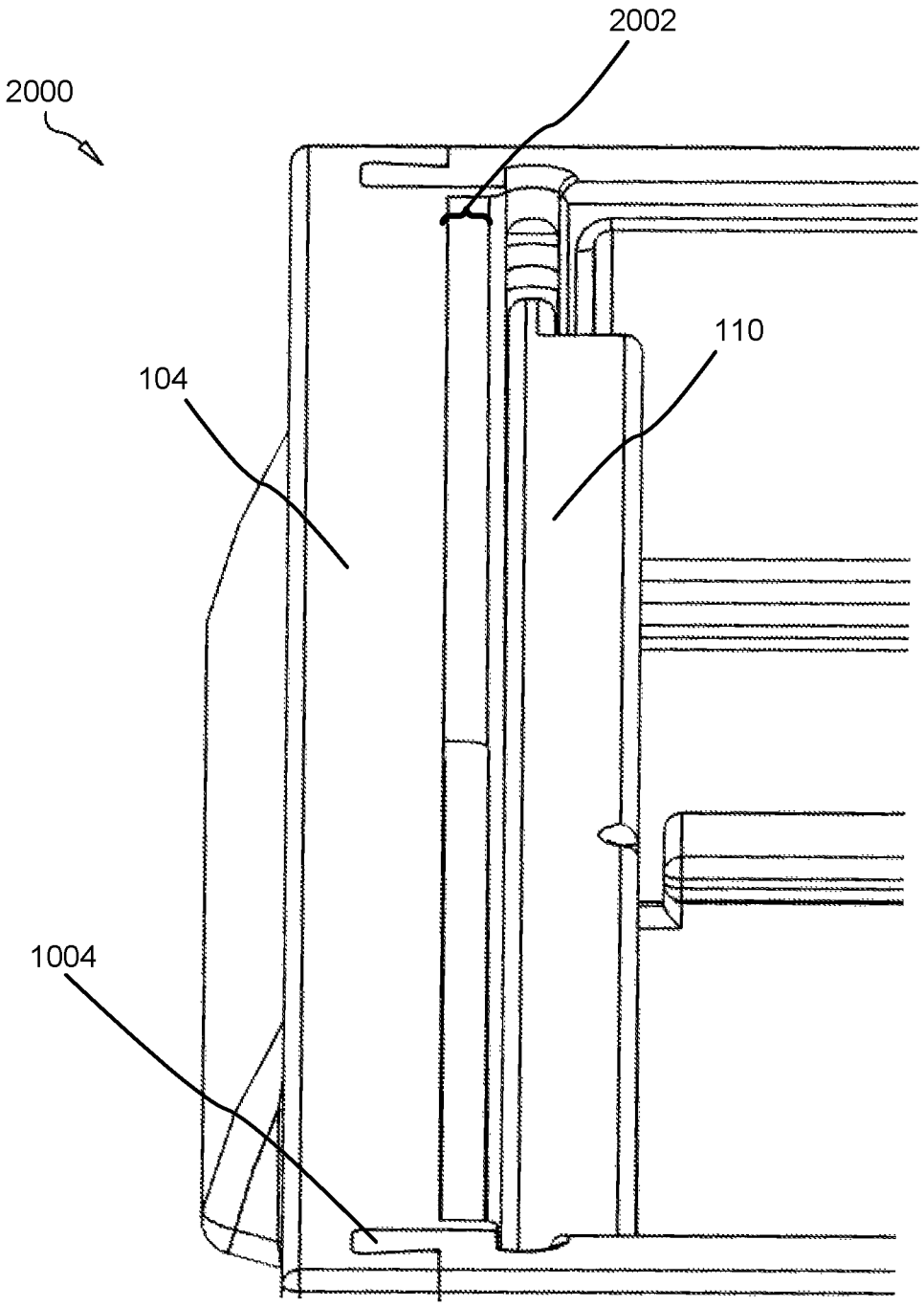
FIG. 20 illustrates an exploded view of a modular tote container in accordance with the present invention.

FIG. 20 illustrates an exploded view of a modular tote container 2000 in accordance with the present invention.

The divider 110 is set back slightly from the rearward surface of the forward panel 104 forming a document recess 2002 between the divider 110 and the forward panel 104. Papers 214 or document inserted into this recess 2002 are visible through the cutout recess 202. In this manner, the apparatus 2000 is adapted to allow labeling of the tote container 2000 without the need for stick-on labels 212 in various embodiments, but rather with paper merely inserted into the recess 2002. The recess 2002 may measure from 0.05 inches to 5 inches in width.

Figure 21:
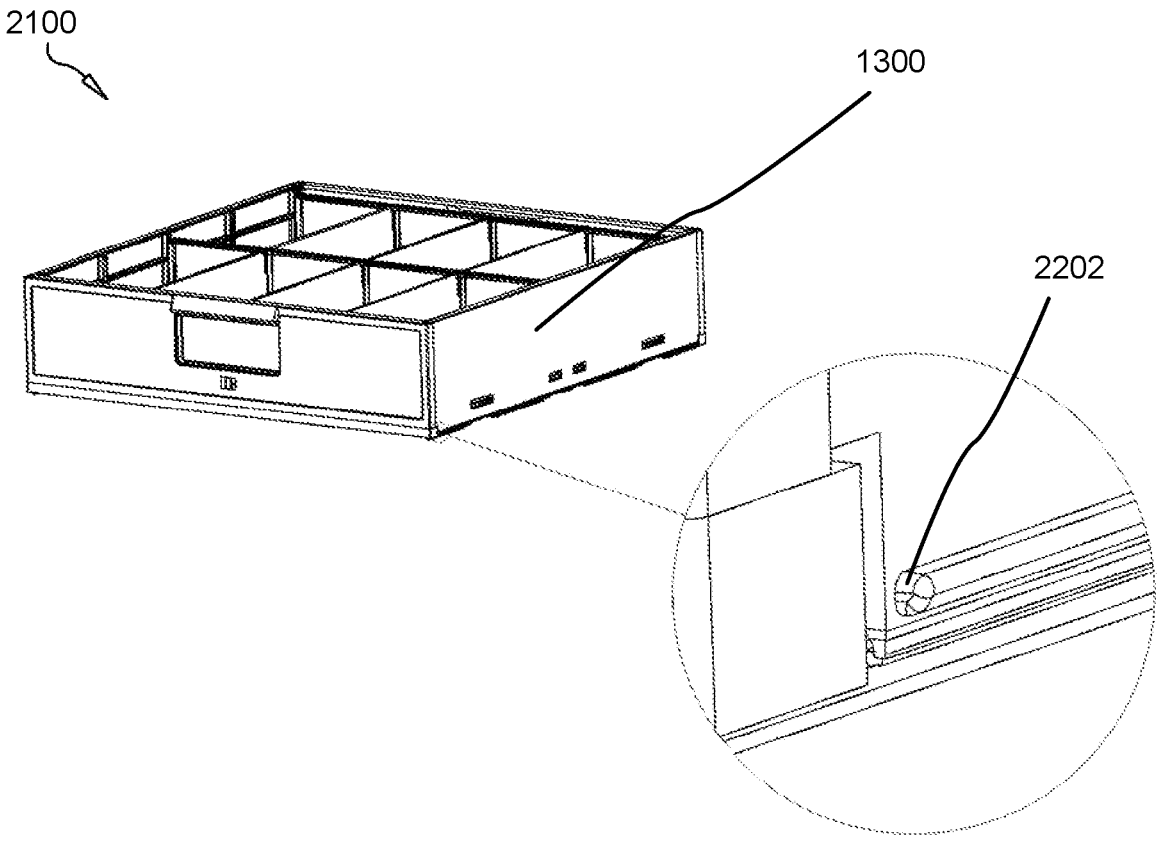
FIG. 21 illustrates an exploded view of a modular tote container and tote track in accordance with the present invention.
Figure 22:
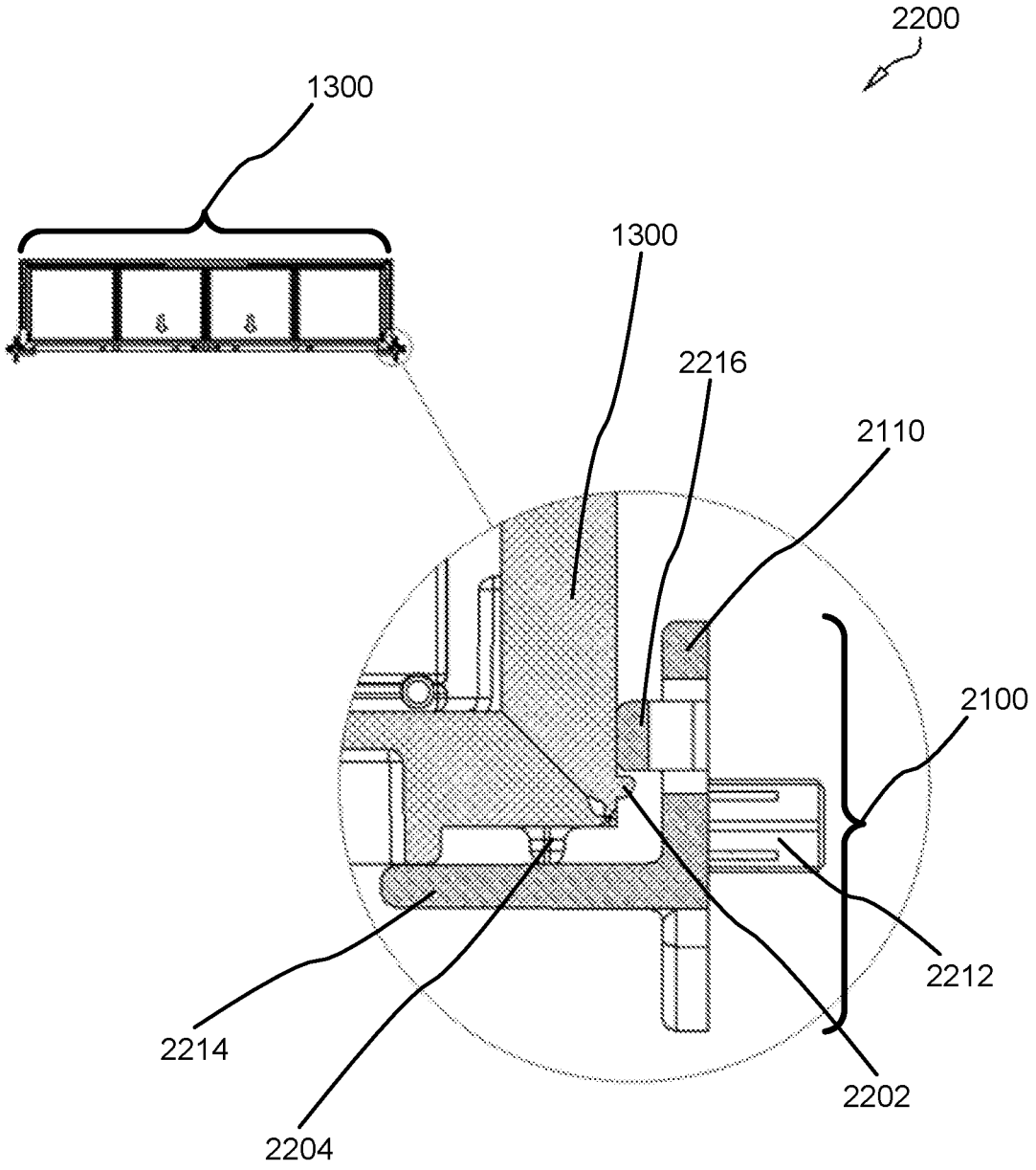
FIG. 22 illustrates an exploded view of a modular tote container and tote track in accordance with the present invention.

FIGS. 21-22 illustrate an exploded view of a modular tote container and tote track in accordance with the present invention.

The tote container 1300 may comprise a lateral protuberance 2202 which juts laterally from the tote container near a lower edge. The tote container 1300 may comprise a plurality of lateral protuberances 2202 arranging linearly above a lower edge of the tote container 1300. The lateral protuberances 2202 hold a bumper 2216 of a tote track 2100 above.

The tote track 2100 comprises a vertical component 2110 and a horizontal component 2214. A second vertical component extends inferiorly from the horizontal component 2214. In various embodiments, a bracket 2212 juts laterally from the vertical component 2110.

In various embodiments, a lower protuberance 2204 affixes to a lower edge of the tote container 1300.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A modular tote container comprising:

a base panel having a planar bottom surface, the base panel comprising a plurality of upwardly-rising L-shaped brackets, the base panel defining a plurality of forward slots along a forward edge adapted to receive corresponding tabs on a front panel, the base panel defining a plurality of mid-slots adapted to receive tabs affixed to one or more dividers, the base panel defining a plurality of rearward slots;

a pair of side panels defining a plurality of rectangular apertures adapted to receive the L-shaped brackets, the side panels adapted to detachably join with the base panel via the brackets;

a pair of terminal panels comprising one or more inferiorly-jutting tabs adapted to insert into the forward slots on the base panel;

one or more vertical dividers comprising one or more inferiorly-jutting tabs adapted to insert into a mid-slot on the base panel;

whereby, the side panels, the front panel, a back panel and the base panel collectively form a cavity within which items may be stowed;

a lid adapted to dispose over the cavity.

2. The tote container of claim 1, wherein each bracket comprises an L-shaped protuberance having a laterally-protruding cantilever.

3. The tote container of claim 2, wherein the base panel comprises two or more slots adapted to receive a tab of a divider.

4. The tote container of claim 2, wherein the side panels each comprise a forward edge adapted to dovetail with a vertical socket recessed into a rearward edge of the front panel.

5. The tote container of claim 4, wherein the front panel defines two socket recesses adapted to receive a forward edge of a side panel.

6. The tote container of claim 4, wherein the forward edge of the side panel comprises a plurality of pins.

7. The tote container of claim 1, wherein the lid comprises ribs and a plurality of snap locks.

8. The tote container of claim 1, wherein the base panel and side panels comprise ribs.

9. The tote container of claim 1, wherein the terminal panels define a rectangular cutout.

10. The tote container of claim 1, wherein the base panel defines two or more intersecting slots.

11. The tote container of claim 1, where the base panel and side panels are hingedly affixed using a live hinge.

12. The tote container of claim 1, further comprising a plurality of lateral dividers defining a plurality of longitudinally-running grooves.

13. The tote container of claim 1, further comprising a plurality of lateral protuberances arranged linearly.

14. The tote container of claim 1, further comprising a tote track comprising a horizontal component, a first vertical component affixed to the horizontal component, a second vertical component jutting inferiorly from the horizontal component, and a bracket, the tote track adapted to slide across a plurality of lateral protuberances.

15. A modular tote container comprising:

a base panel having a planar bottom surface, the base panel comprising a plurality of upwardly-rising L-shaped brackets, each L-shaped brackets comprising a laterally-protruding cantilever superiorly positioned on the bracket adapted to detachably mate with an aperture of a side panel;

the base panel defining a plurality of forward slots along a forward edge adapted to receive corresponding tabs on a front panel, the base panel defining a plurality of mid-slots adapted to receive tabs affixed to one or more dividers, the base panel defining a plurality of rearward slots;

a pair of side panels affixed to the base panel using a live hinge, the side panels defining a plurality of rectangular apertures adapted to receive the L-shaped brackets, the side panels adapted to detachably join with the base panel via the brackets;

a forward panel comprising one or more inferiorly-jutting tabs adapted to insert into slots on the base panel;

a back panel comprising one or more inferiorly-jutting tabs adapted to insert into one of forward slots and rearward slots on the base panel;

one or more vertical dividers comprising one or more inferiorly-jutting tabs adapted to insert into a slot on the base panel;

whereby, the side panels, front panel, back panel and base panel collectively form a cavity within which items may be stowed;

a lid adapted to dispose over the cavity comprises ribs and gussets.

* * * * *